US008052347B2

(12) United States Patent
Frankeny, II et al.

(10) Patent No.: US 8,052,347 B2
(45) Date of Patent: Nov. 8, 2011

(54) CONCRETE SCREED WITH PIVOTING LEADING—EDGE BLADE FOR ANGULAR POSITIONING THEREOF

(75) Inventors: Albert D. Frankeny, II, Wilmington, NC (US); S. Allen Face, III, Leland, NC (US)

(73) Assignee: Laser Strike, LLC, Wilmington, NC (US)

( * ) Notice: Subject to any disclaimer, the term of this patent is extended or adjusted under 35 U.S.C. 154(b) by 294 days.

(21) Appl. No.: 12/322,149

(22) Filed: Jan. 29, 2009

(65) Prior Publication Data

US 2010/0189499 A1 Jul. 29, 2010

(51) Int. Cl.

| | |
|---|---|
| ***E01C 23/07*** | (2006.01) |
| ***E01C 19/22*** | (2006.01) |
| ***E01C 19/42*** | (2006.01) |
| ***E01C 23/00*** | (2006.01) |
| ***E01C 19/00*** | (2006.01) |

(52) U.S. Cl. ..... 404/118; 404/83; 404/84.1

(58) Field of Classification Search ..... 404/118, 404/112, 83, 84.1

See application file for complete search history.

(56) References Cited

U.S. PATENT DOCUMENTS

| | | | | |
|---|---|---|---|---|
| 4,752,156 | A * | 6/1988 | Owens | 404/118 |
| 5,549,413 | A * | 8/1996 | Bolden | 404/93 |
| 5,568,992 | A * | 10/1996 | Grembowicz et al. | 404/101 |
| 6,758,631 | B2 * | 7/2004 | Frankeny, II | 404/118 |
| 6,953,304 | B2 * | 10/2005 | Quenzi et al. | 404/114 |
| 6,981,819 | B1 * | 1/2006 | Suckow et al. | 404/114 |
| 7,121,762 | B2 * | 10/2006 | Quenzi et al. | 404/84.1 |
| 7,195,423 | B2 * | 3/2007 | Halonen et al. | 404/84.5 |
| 2006/0257206 | A1 * | 11/2006 | Face et al. | 404/118 |
| 2006/0257207 | A1 * | 11/2006 | Face et al. | 404/118 |

* cited by examiner

*Primary Examiner* — Thomas Will
*Assistant Examiner* — Abigail A Risic
(74) *Attorney, Agent, or Firm* — Peter J. Van Bergen

(57) ABSTRACT

A floating screed device has a first section for cutting through plastic concrete and a second section for floating on the plastic concrete. The two sections are pivotally coupled for rotational movement about a pivot point. Elevation of the second section is measured and used to rotate the first section as the floating screed device is moved through a volume of the plastic concrete that is unfinished. As a result, the second section pitches to follow the first section.

20 Claims, 4 Drawing Sheets

CONCRETE SCREED WITH PIVOTING LEADING—EDGE BLADE FOR ANGULAR POSITIONING THEREOF

CROSS-REFERENCE TO RELATED PATENT APPLICATION

This patent application is co-pending with one related patent application entitled "CONCRETE SCREED WITH VERTICALLY ADJUSTABLE GATE", Ser. No. 12/069, 743, filed Feb. 12, 2008, by the same inventors and owned by the same assignee as this patent application.

FIELD OF THE INVENTION

The invention relates generally to screed devices, and more particularly to a floating screed device that has a leading edge that can pivot to an angular position with respect to a trailing float.

BACKGROUND OF THE INVENTION

Floating screeds are used to strike off and finish concrete floors or other horizontal surfaces. In general, a floating screed has a heavy planar float with an elongated edge defining a blade. The blade forms the leading edge of the screed that cuts through a volume of plastic concrete as the screed is pulled therethrough. Excess concrete that builds up on the blade side of the screed is raked away by workers standing in the unfinished concrete. As the float moves over an area of the concrete cut by the blade, the float serves to smooth the concrete thereby leaving a finished region of concrete that should be smooth, level, and at a specified elevation.

Typically, the unfinished concrete is adjacent to a section of finished concrete that has not yet cured. The floor finishers generally place a portion of the floating screed on the finished concrete thereby referencing one end of the screed to the finished elevation/grade plane. To make elevation corrections in the unfinished concrete, the floating screed is essentially lifted up/pushed down on the portion thereof that is in the unfinished concrete. While the goal is to place the screed at the same elevation as the finished concrete, this action tends to tilt the floating screed with respect to the desired finished elevation. Further, since the finished concrete is generally not yet fully cured, this tilting action also can cause the floating screed to dig into the finished concrete and/or damage the edge of the finished concrete where it interfaces with the unfinished concrete thereby necessitating repair work.

SUMMARY OF THE INVENTION

Accordingly, it is an object of the present invention to provide a floating screed device that can be controlled to produce smooth and level concrete surfaces at a desired elevation.

Another object of the present invention is to provide a floating screed device that can take advantage of a reference elevation defined by finished-but-uncured concrete without subjecting same to subsequent repair.

Other objects and advantages of the present invention will become more obvious hereinafter in the specification and drawings.

In accordance with the present invention, a floating screed device has a first section defining a leading edge for cutting through plastic concrete. A second section has a planar bottom for floating on the plastic concrete. A pivot is used to couple the first section to the second section such that the first section can move rotationally about the pivot relative to the second section. The pivot assures that the rotational movement of the first section is substantially perpendicular to the planar bottom of the second section. An elevation determining system coupled to the second section determines elevation of the second section relative to a datum that is typically indicative of a target elevation of the concrete. A mechanism coupled to the first section and second section supports the first section relative to the second section, and causes the first section to move rotationally about the pivot by an amount based on the elevation determined as the floating screed device is moved through a volume of the plastic concrete that is unfinished. The first section's leading edge defines an initial contact edge between the floating screed device and the volume of the plastic concrete that is unfinished.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
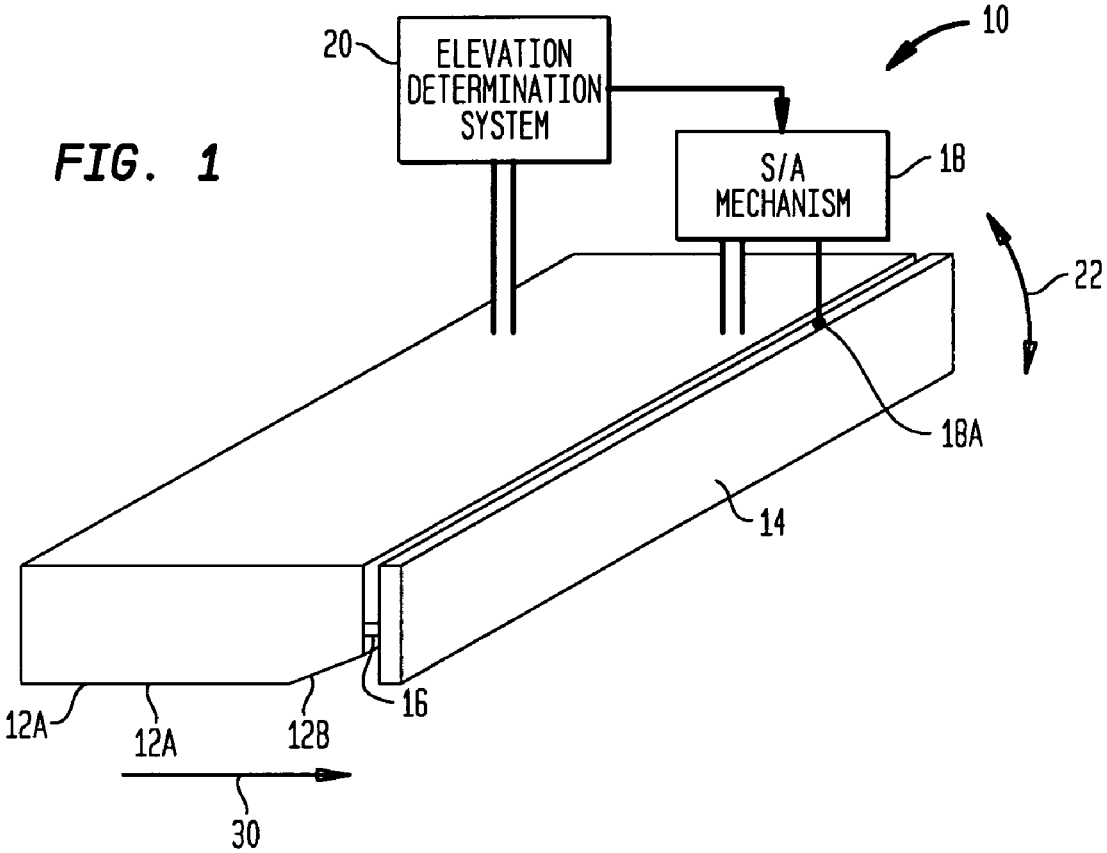
FIG. 1 is a perspective view of a floating screed device in accordance with an embodiment of the present invention.
Figure 2:
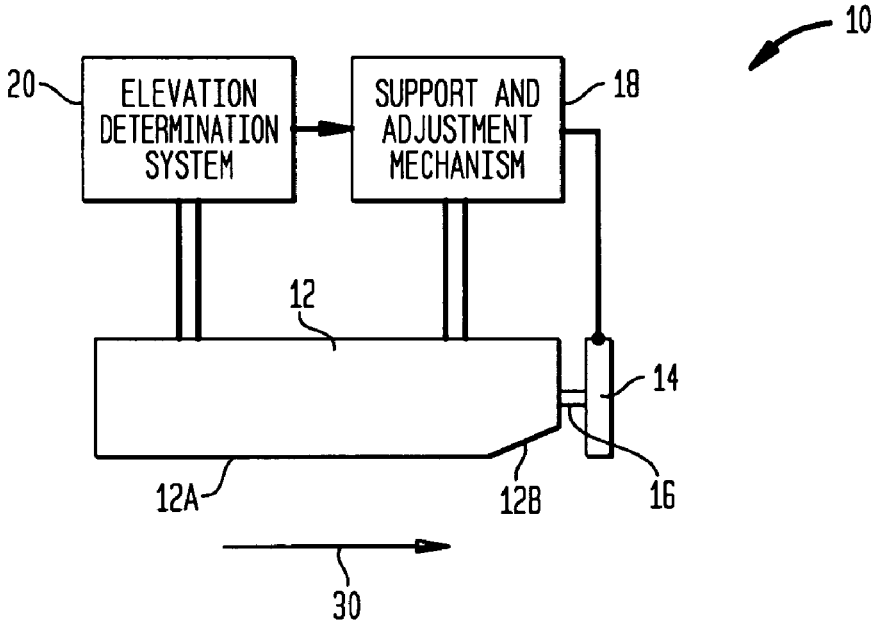
FIG. 2 is a side schematic view of the floating screed device of FIG. 1.

Referring now to the drawings, and with simultaneous reference to FIGS. 1 and 2, an embodiment of a floating screed device in accordance with the present invention is shown and is referenced generally by numeral 10. Floating screed device 10 is an elongate device as would be well understood in the art. Floating screed device 10 includes:

(i) an elongate float 12, (ii) a bar 14 spaced apart from float 12 and substantially commensurate in length with float 12, (iii) a pivot coupling (e.g., a pin) 16 that couples one end of bar 14 to a corresponding end of float 12 such that bar 14 can move in a rotational plane about pivot coupling 16 and relative to float 12, (iv) a support and adjustment ("S/A") mechanism 18 coupled to each of float 12 and bar 14 for maintaining the spaced-apart relationship therebetween and for adjusting the rotational-plane position of bar 14 relative to float 12; and (v) an elevation determination system 20 coupled to float 12 for determining the elevation of float 12 and for providing such elevation to S/A mechanism 18 to thereby control the rotational-plane position of bar 14.

The functional relationships of the elements and the operation of floating screed device 10 will be explained in greater detail below.

Float 12 defines a planar bottom 12A that "floats" on a plastic concrete surface (not shown) to be finished. Float 12 can be substantially rectangular in cross-section (as shown), and can have a beveled, lower leading edge 12B to facilitate movement over concrete. However, float 12 can be defined by other geometric shapes without departing from the scope of the present invention. Float 12 can be hollow, solid, or filled with a granular material, a solid material, or a fluid.

Bar 14 is an elongate piece of stiff material movable by the combination of pivot coupling 16 and S/A mechanism 18. More specifically, pivot coupling 16 and S/A mechanism 18 cooperate to move bar 14 in a rotational plane (indicated by two-headed curved arrow 22) that is substantially perpendicular to planar bottom 12A. Movement of bar 14 in a rotational plane that is substantially perpendicular to bottom 12A will generally result in an angular position of bar 14 with respect to bottom 12A. Bar 14 defines the leading edge of floating screed device 10 as screed device 10 is moved in the direction of arrow 30.

With respect to bar 14, its shape and construction details can be any that would allow bar 14 to cut through plastic concrete as floating screed device 10 was moved along direction 30. For example, bar 14 could be a rigid piece of solid or hollow material (e.g., metal, wood, composite, etc.), and can have a rectangular cross-section as shown. However, it is to be understood that the cross-sectional shape of bar 14 is not a limitation of the present invention.

Pivot coupling 16 is any device or combination of elements that attaches bar 14 to float 12 in a relationship that supports the rotational-plane movement thereof indicated by arrow 22. For example, pivot coupling could place bar 14 in a spaced-apart relationship with respect to float 12 as shown. However, the present invention is not so limited as pivot coupling 16 could also be designed to support bar 14 in an abutting but sliding relationship with float 12, i.e., no space between bar 14 and float 12. In practice, the amount of rotational-plane movement of bar 14 is relatively small (e.g., typically on the order of about 1° or less) as screed device 10 moves through wet concrete during a finishing operation. To minimize the impact of the lower corner 14A of bar 14 on wet concrete when bar 14 is angularly positioned (relative to a horizontal datum), pivot coupling 16 is located as close as possible to lower corner 14A and planar bottom 12A. Additionally or alternatively, lower corner 14A can be "clipped" or otherwise shaped/configured for minimal impact on wet concrete when bar 14 is angularly positioned relative to planar bottom 12A.

With respect to S/A mechanism 18, its design and construction can be any that supports bar 14 in its spaced-apart relationship with float 12, while also facilitating the above-described rotational-plane movement of bar 14 relative to float bottom 12A. S/A mechanism 18 would typically include a powered actuator (e.g., hydraulic, electric solenoid, etc.) that could be controlled/operated manually. However, in most applications, screed device 10 includes a height/level defining system (e.g., elevation determination system 20) coupled to S/A mechanism 18 to effect automatic rotational-plane movement of bar 14 as screed device 10 moves in the direction of arrow 30.

In accordance with the present invention, elevation determination system 20 is mounted to float 12 such that its elevation measurement location is substantially aligned with the point of actuation 18A of S/A mechanism 18 along the device's direction of travel indicated by arrow 30. System 20 can be part of a laser level system, the use of which in concrete floor construction is well known and understood. In general, elevation determination system 20 determines the height of float 12 (e.g., planar bottom 12A of float 12 aligned with point of actuation 18A) relative to a target height that ultimately is indicative of the finish elevation of the concrete.

It has been found that wet concrete tends to bubble up after the leading edge of a screed device passes over/through wet concrete. That is, the leading edge (i.e., bar 14) of a two-section screed device does not necessarily define the finish elevation of wet concrete. Accordingly, the present invention uses float 12 to set the ultimate finish elevation of the wet concrete as bar 14 is adjusted based on the elevation of float 12 relative to a datum or target elevation. By constructing the floating screed in this way, float 12 corrects the "bubbling concrete" condition to thereby finish the wet concrete to the desired elevation.

The output of system 20 is an amount of movement of bar 14 (i.e., relative to planar bottom 12A) required to achieve the target height as floating screed device 10 is moved in the direction of arrow 30. The output of system 20 is supplied to S/A mechanism 18 which, in turn, applies the requisite amount of up or down force to bar 14 to thereby angularly position bar 14 relative to planar bottom 12A. Thus, the present invention allows bar 14 to be tilted (with respect to planar bottom 12A) along the length thereof.

The above-described tilting or angular positioning of bar 14 is necessitated by the general nature of concrete finishing operations where a region of wet concrete is generally adjacent a region of concrete that is already at its finished elevation. Accordingly, one end of screed device 10 (i.e., near pivot coupling 16) is generally located on or next to the finished concrete while the remainder of screed device 10 resides on the wet concrete. In most applications, a screed operator will place one end of the screed device directly on concrete that has already been finished but has not yet cured (or "finished-but-uncured" concrete as it will also be referred to herein). By doing this, the portion of screed device 10 supporting S/A mechanism 18 and elevation determination system 20 can be tilted up or down relative to the finished concrete elevation. The present invention's ability to angularly position bar 14 relative to float bottom 12A during the screed process allows the screed device to direct float bottom 12A to the target or finish elevation as will now be explained with the aid of FIGS. 3A-3C.

The present invention improves concrete finishing as the floating screed device is more easily manipulated to a finished-concrete target elevation. To illustrate operation of the present invention, reference will now be made to FIGS. 3A-3C where a region 100 of finished concrete at a desired target elevation is adjacent to a region 102 of unfinished concrete. For purpose of illustration, operations will be described as floating screed device 10 moves in direction 30 through region 102. Relative to direction 30, the unfinished volume of plastic concrete in region 102 is forward of device 10 while finished concrete (not shown) trails device 10. The unfinished volume of plastic concrete in region 102 is typically at a height above the target elevation defined by the surface of region 100 so that bar 14 must cut therethrough.

Figure 3A:
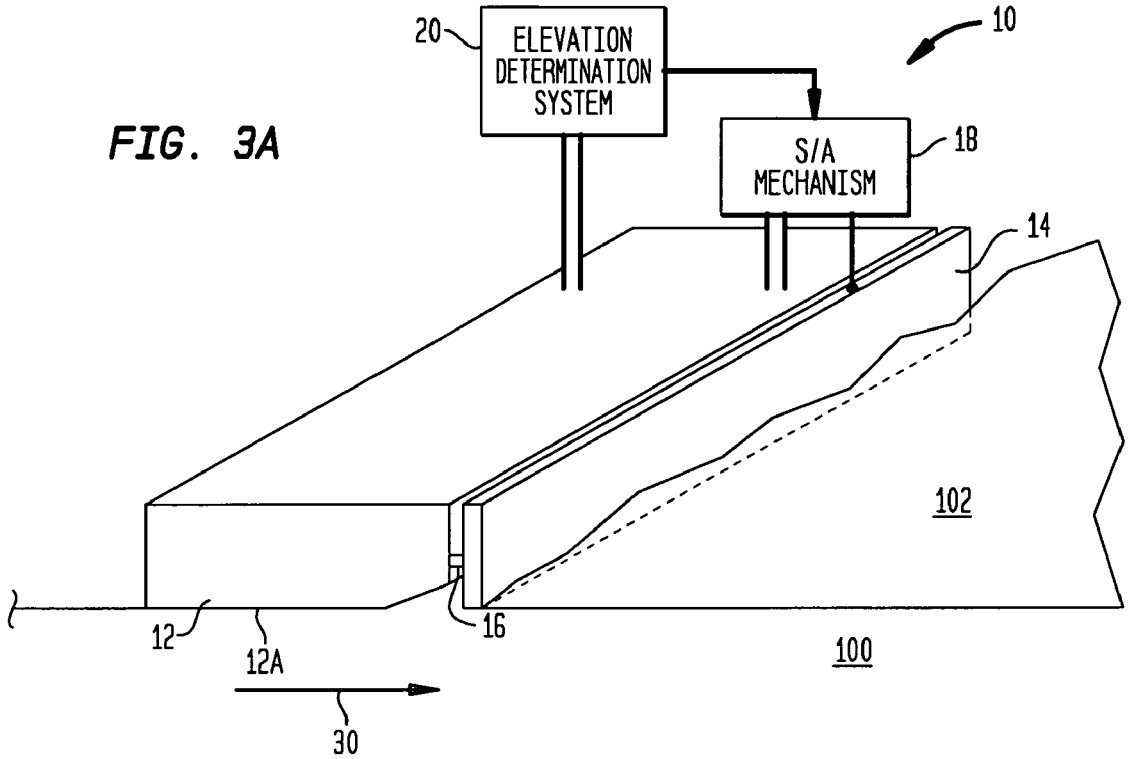
FIG. 3A is a perspective view of the floating screed device of FIG. 1 operating at a target elevation.

In use, whatever the orientation of planar bottom 12A of float 12 (e.g., horizontal and at the target elevation, tilted above/below the target elevation), the operational goal of screed device is to direct planar bottom 12A to ride on the concrete at the target elevation. In FIG. 3A, floating screed device 10 is "on grade" with both bottom edge 14A of bar 14 and planar bottom 12A of float 12 at the target elevation defined by the surface of region 100. That is, device 10 is tilted with respect to the surface of region 100.

Figure 3B:
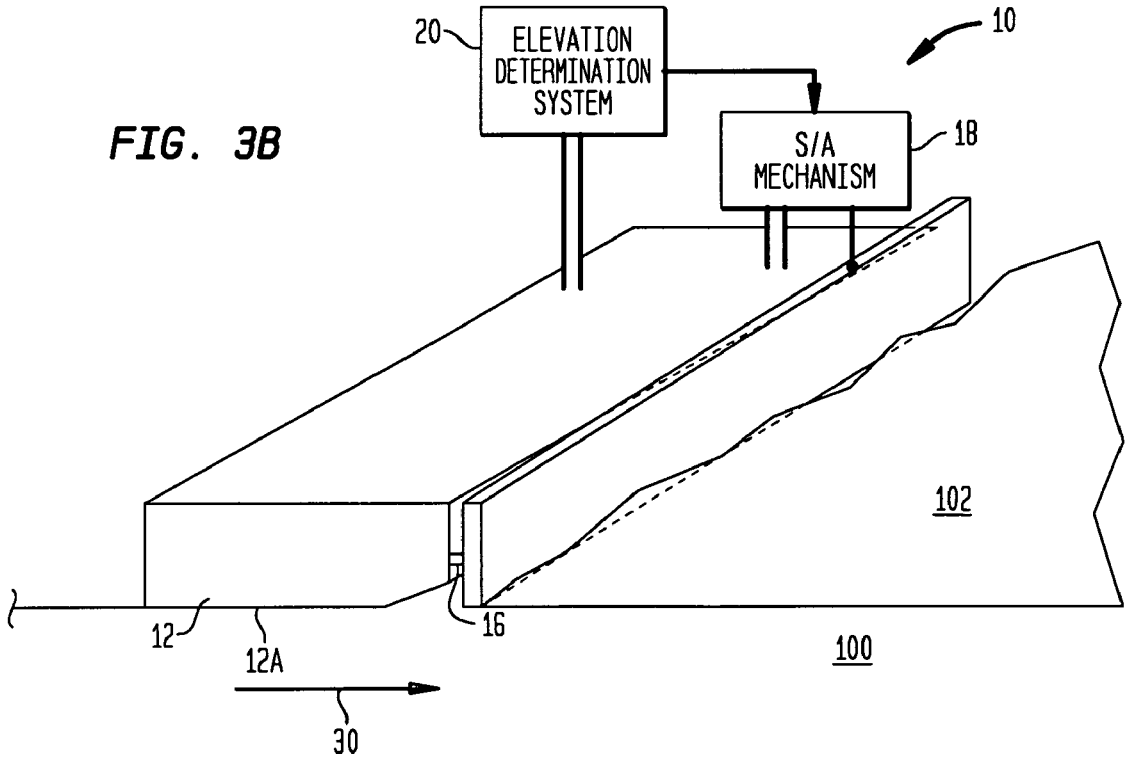
FIG. 3B is a perspective view of the floating screed device of FIG. 1 with the float thereof tilted below a target elevation.

In FIG. 3B, bottom 12A of float 12 is tilted below the target elevation defined by the surface of region 100. The measured elevation (provided by elevation determination system 20) of the lower end of float 12 is used by S/A mechanism 18 to rotate bar 14 up by an amount that causes bottom edge 14A to be positioned at the target elevation defined by the surface of region 100. As device 10 advances in direction 30, the lower end of float 12 will pitch or "ski" up as it encounters an uphill slope in the concrete created by the raised position of bar 14.

Figure 3C:
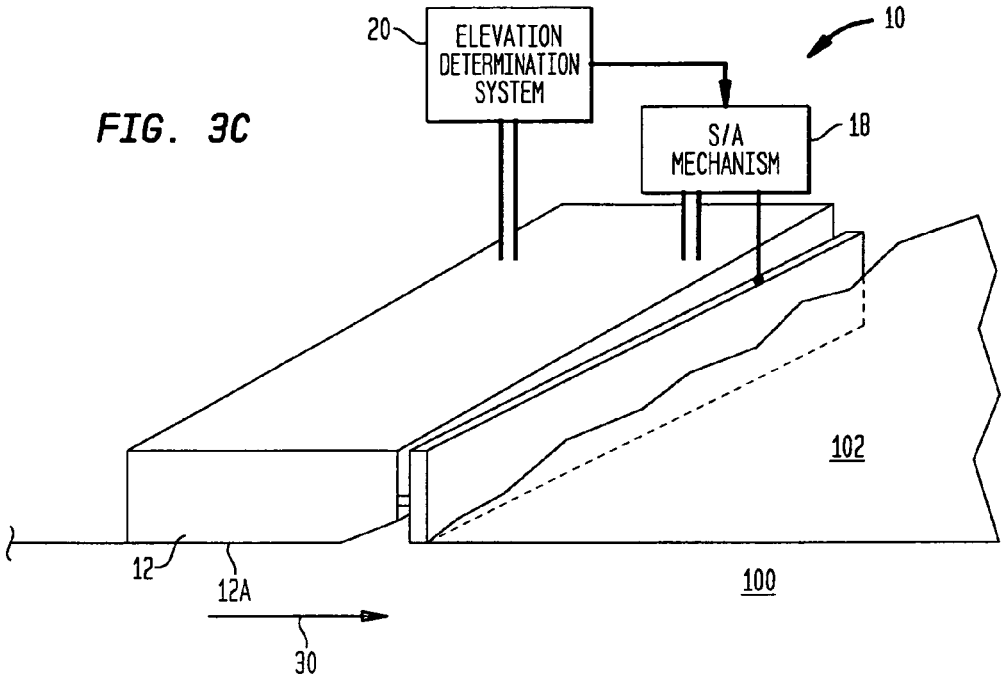
FIG. 3C is a perspective view of the floating screed device of FIG. 1 with the float thereof tilted above a target elevation.

In FIG. 3C, bottom 12A of float 12 is tilted above the target elevation defined by the surface of region 100. This time, S/A mechanism 18 (as controlled by the measurements from elevation determination system 20) rotates bar 14 down to position bottom edge 14A at the target elevation defined by the surface of region 100. As device 10 advances in direction 30, the higher end of float 12 will pitch or "ski" down as it encounters a downhill slope in the concrete created by the lowered position of bar 14.

Figure 4:
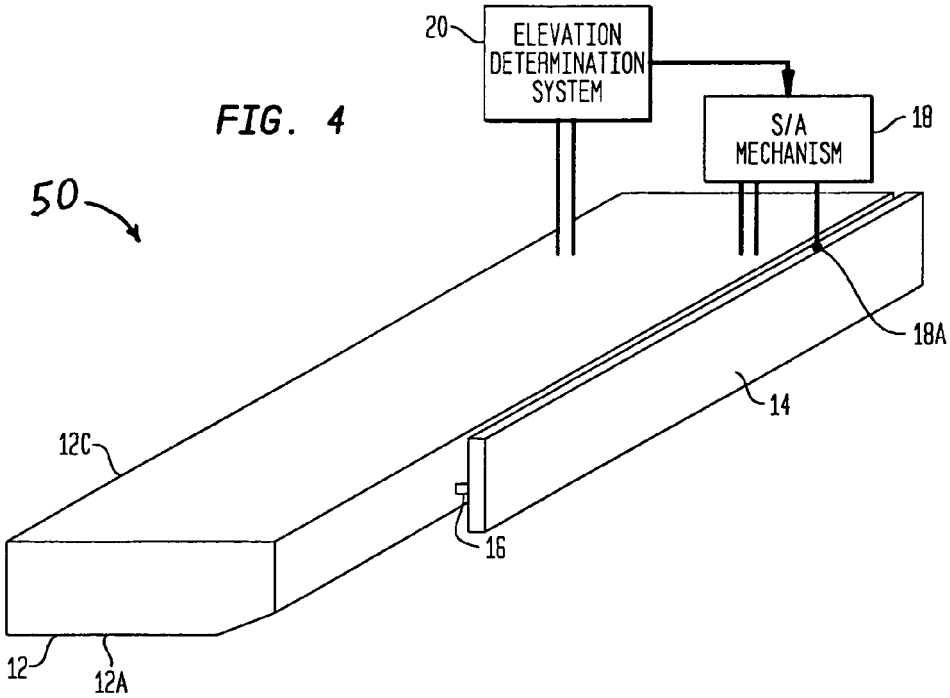
FIG. 4 is a perspective view of a floating screed device in accordance with another embodiment of the present invention.

Recognizing that screed operators prefer to use an edge of a finished region of concrete as a "one side" reference, the present invention can also be practiced by a floating screed device 50 illustrated in FIG. 4. Screed device 50 is nearly identical to screed device 10 except that float 12 is longer than bar 14. Specifically, a portion 12C of float 12 extends past bar 14 where it is coupled to float 12 by pivot coupling 16. Bar 14 will typically extend to the other end of float 12 in this embodiment. When using screed device 50, the operator places float portion 12C on the finished concrete. Since there is no portion of bar 14 riding on the finished concrete, float portion 12C simply "floats" on the finished concrete. The advantage of this embodiment is that bar 14 does not come into contact with the finished concrete where such contact could result in damage to the finished surface. Screed device 50 will be particularly useful when the finished concrete falls into the "finished-but-uncured" classification.

Figure 5:
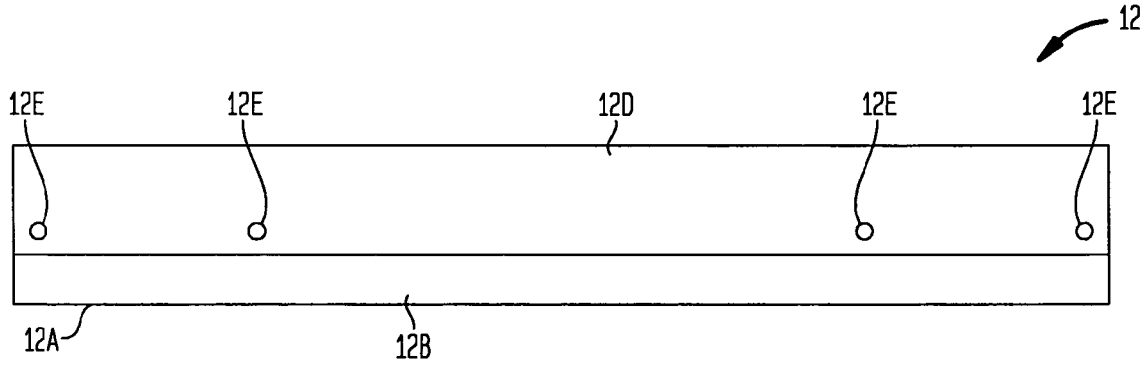
FIG. 5 is an isolated head-on view of the float identifying a plurality of possible pivot coupling positions.

The front face of float 12 can be configured to support multiple positions for pivot coupling 16. In this way, the floating screed device of the present invention can be adapted to work with finished regions of concrete on either side of an unfinished region of concrete by simple re-positioning of bar 14. Accordingly, FIG. 5 illustrates the front face 12D of float 12 having multiple locations 12E that can be configured to accept a pivot coupling 16. In the illustrated embodiment, there is a location 12E located at either end of float 12 to support the pivot mounting of a bar thereto in which case the resulting screed device will resemble the embodiment shown in FIG. 1. In addition, there are two inboard locations 12E to support the pivotal mounting of a shorter-length bar thereto in which case the resulting screed device will resemble the embodiment shown in FIG. 4.

Figure 6:
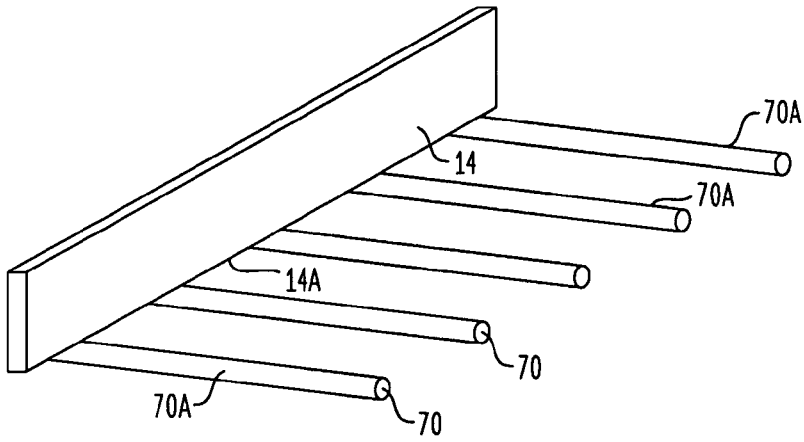
FIG. 6 is an isolated perspective view of the floating screed device's leading edge bar equipped with a rake guide formed by rigid fingers extending from the bottom edge of the bar.

Owing to the weight and density of unfinished concrete, it is necessary for the rake workers (i.e., those workers standing in the unfinished concrete forward of the screed operator) to prevent any substantial build up of unfinished concrete just ahead of the screed as this makes the screed operator's job extremely difficult. To prevent a rake worker's removal of too much or too little unfinished concrete, a novel type of rake guide can be added to bar 14 to provide the rake workers with a guide that would prevent concrete build up at the blade's leading edge. The rake guide is illustrated in FIG. 6 where bar 14 (shown in isolation) has a plurality of rigid fingers 70 attached thereto along bottom edge 14A. Fingers 70 protrude forward from bar 14 with the exposed tops 70A thereof being aligned with bottom edge 14A. In this way, tops 70A define a planar region along which a rake (not shown) can be guided.

Spacing between adjacent ones of fingers 70 is such that a rake worker's blade (not shown) will rest on at least two of fingers 70 when the rake blade is placed thereon. The protruding length of fingers 70 defines a region forward of bar 14 that will be free of concrete build-up as a rake worker pulls wet concrete therealong. The length of fingers 70 can be any reasonable length over which they remain rigid. If the length of fingers 70 is such that it causes a change in the bar's balance, counter weights (not shown) can be used to re-balance the bar. The shape of fingers 70 is not a limitation of the present invention. For example, the cross-sectional shape of fingers 70 can be round (as shown) or any other shape without departing from the scope of the present invention. Regardless of their shape, any minor grooves formed by fingers 70 in the unfinished concrete are quickly "floated" to the finish concrete height as float 12 (tracking behind bar 14) moves thereover.

Fingers 70 could also be colored along the length thereof in one or more colors that are different from the color of the plastic concrete being finished. Fingers 70 could just be colored all along their length or just near their outboard ends. By coloring fingers 70 in this way, the rake worker is provided with both tactile feedback (i.e., as the rake contacts fingers 70) and visual feedback.

The advantages of the present invention are numerous. The floating screed's pivoting leading edge presents a novel way for a screed operator to take advantage of a finished region of concrete adjacent to an unfinished region of concrete. By using the trailing float as the point for measuring elevation with respect to a target elevation, the present invention corrects the "bubbling concrete" condition that occurs when a screed device has a leading section followed by a second section spaced apart from the leading section.

Thus, although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A floating screed device, comprising:

a first section defining a leading edge for cutting through plastic concrete;

a second section having a planar bottom for floating on the plastic concrete;

a pivot coupling a longitudinal end of said first section to a single location on said second section wherein said first section can move rotationally about said pivot in a plane of rotation defined relative to said second section and substantially perpendicular to said planar bottom of said second section;

elevation determining means coupled to said second section for determining elevation of said second section relative to a datum; and means coupled to said first section and said second section for supporting said first section relative to said second section and for causing said first section to move rotationally about said pivot by an amount based on said elevation so-determined as said floating screed device is moved through a volume of the plastic concrete that is unfinished with said leading edge defining an initial contact edge between said floating screed device and the volume of the plastic concrete that is unfinished.

2. A floating screed device as in claim 1, wherein said pivot is located at an inboard location along the length of said second section, and wherein said first section terminates at one end thereof approximately at said inboard location.

3. A floating screed device as in claim 2, wherein another end of said first section terminates at approximately an outboard edge of said second section.

4. A floating screed device as in claim 1, wherein said second section defines a plurality of inboard locations that can support said pivot that couples said first section to said second section.

5. A floating screed device as in claim 1, wherein said elevation determining means includes a laser receiver.

6. A floating screed device as in claim 1, further comprising a plurality of rigid and spaced-apart fingers coupled to a bottom edge of said first section and extending therefrom with tops of said fingers defining a planar region aligned with said bottom edge.

7. A floating screed device, comprising:

an elongated float having a planar bottom for floating on plastic concrete;

means coupled to said elongated float for determining elevation thereof relative to a target elevation in the plastic concrete;

an elongated and rigid bar spaced apart from said float and pivotally coupled on only one end thereof to said float, wherein said bar can be angularly positioned with respect to said planar bottom of said float as said bar is moved in a plane of rotation that is substantially perpendicular to said planar bottom of said float; and a support and adjustment mechanism coupled to said float, said bar and said means for determining elevation, for maintaining said bar spaced apart from said float and for moving said bar in said plane based on said elevation so-determined as said floating screed device is moved through a volume of the plastic concrete that is unfinished with said bar defining an initial contact edge between said floating screed device and the volume of the plastic concrete that is unfinished.

8. A floating screed device as in claim 7, wherein said bar is shorter in length than said float.

9. A floating screed device as in claim 8, wherein said one end of said bar is pivotally coupled to said float at an inboard location therealong with an opposing end of said bar being substantially aligned with an outboard edge of said float.

10. A floating screed device as in claim 9, wherein said support and adjustment mechanism is coupled to said bar in proximity to said opposing end thereof.

11. A floating screed device as in claim 7, wherein said bar is pivotally coupled to said float in proximity to said planar bottom thereof.

12. A floating screed device as in claim 7, wherein said float includes a plurality of locations therealong that can support said bar being pivotally coupled thereto.

13. A floating screed device as in claim 7, wherein said means for determining elevation includes a laser receiver.

14. A floating screed device as in claim 7, further comprising a plurality of rigid and spaced-apart fingers coupled to a bottom edge of said bar and extending therefrom with tops of said fingers defining a planar region aligned with said bottom edge.

15. A floating screed device, comprising:

an elongated float having a planar bottom for floating on plastic concrete, said float having a length $L_F$;

means coupled to said elongated float for determining elevation thereof relative to a target elevation in the plastic concrete;

an elongated and rigid bar, said bar having a length $L_B$ wherein $L_F > L_B$, said bar spaced apart from said float and pivotally coupled only on one longitudinal end thereof to said float at a single pivot location defined on said float, said pivot location being approximately $(L_F - L_B)$ from an outboard edge of said float, wherein said bar can be angularly positioned with respect to said planar bottom of said float as said bar is moved in a plane of rotation about said single pivot location and wherein said plane is substantially perpendicular to said planar bottom of said float; and a support and adjustment mechanism coupled to (i) said float, (ii) said bar, and (iii) said means for determining elevation, for maintaining said bar spaced apart from said float and for moving said bar in said plane based on said elevation so-determined as said floating screed device is moved through a volume of the plastic concrete that is unfinished with said bar defining an initial contact edge between said floating screed device and the volume of the plastic concrete that is unfinished.

16. A floating screed device as in claim 15, wherein said support and adjustment mechanism is coupled to said bar in proximity to an opposing longitudinal end thereof.

17. A floating screed device as in claim 15, wherein said bar is pivotally coupled to said float in proximity to said planar bottom thereof.

18. A floating screed device as in claim 15, wherein said float includes at least one additional location that can support said bar being pivotally coupled thereto.

19. A floating screed device as in claim 15, wherein said means for determining elevation includes a laser receiver.

20. A floating screed device as in claim 15, further comprising a plurality of rigid and spaced-apart fingers coupled to a bottom edge of said bar and extending therefrom with tops of said fingers defining a planar region aligned with said bottom edge.

* * * * *